US009378714B1

(12) United States Patent
Baldwin, Sr. et al.

(10) Patent No.: US 9,378,714 B1
(45) Date of Patent: Jun. 28, 2016

(54) ELECTRONIC DRUM

(71) Applicants: Kevin L. Baldwin, Sr., Eaton Rapids, MI (US); Kevin L. Baldwin, Jr., Eaton Rapids, MI (US)

(72) Inventors: Kevin L. Baldwin, Sr., Eaton Rapids, MI (US); Kevin L. Baldwin, Jr., Eaton Rapids, MI (US)

( * ) Notice: Subject to any disclaimer, the term of this patent is extended or adjusted under 35 U.S.C. 154(b) by 0 days.

(21) Appl. No.: 14/618,130

(22) Filed: Feb. 10, 2015

(51) Int. Cl.
*G10D 13/02* (2006.01)
*H04R 29/00* (2006.01)

(52) U.S. Cl.
CPC ..... *G10D 13/024* (2013.01); *H04R 29/004* (2013.01)

(58) Field of Classification Search
CPC ..... G10D 13/024
See application file for complete search history.

(56) References Cited

U.S. PATENT DOCUMENTS 3,553,339 A * 1/1971 Dominguez ..... G10H 3/146 84/725
4,947,725 A * 8/1990 Nomura ..... G10D 13/024 84/723
5,293,000 A * 3/1994 Adinolfi ..... G10D 13/024 84/730
5,416,999 A 5/1995 Coury
5,430,245 A * 7/1995 Rogers ..... G10H 3/146 84/725
5,583,307 A * 12/1996 Tobia, Jr. ..... G10D 13/024 84/411 R
5,816,155 A 10/1998 Stephan
6,317,036 B1 11/2001 Popat et al.
6,318,463 B1 11/2001 Fehrmann et al.
6,576,829 B1 * 6/2003 Hart ..... G10H 3/146 84/104
6,684,734 B2 2/2004 Gatzen
6,721,528 B1 4/2004 Schreieder et al.
6,921,857 B2 * 7/2005 Yoshino ..... G10D 13/024 84/414
6,982,376 B2 * 1/2006 Wise ..... G10H 3/146 84/104
7,015,391 B2 3/2006 Tomoda
7,074,997 B2 7/2006 Steele
7,137,697 B2 11/2006 Lehmann
7,197,957 B2 4/2007 Gatzen
7,259,317 B2 * 8/2007 Hsien ..... G10D 13/024 84/723
7,294,778 B2 11/2007 Susami
7,396,991 B2 * 7/2008 Susami ..... G10H 3/146 84/615
7,435,888 B2 10/2008 Steele
7,531,733 B2 5/2009 Steele
7,560,632 B1 * 7/2009 Lanzel ..... G10D 13/021 84/411 R
7,723,596 B2 * 5/2010 Kelly ..... H04R 1/083 84/421
7,838,753 B2 11/2010 Steele
8,065,987 B2 11/2011 Yang
8,071,871 B2 * 12/2011 Peavey ..... G10D 13/021 84/725
8,178,769 B2 5/2012 Steele
8,344,235 B2 1/2013 Steele
8,431,813 B2 * 4/2013 Mori ..... G10D 13/023 84/411 R
8,563,843 B1 * 10/2013 Shemesh ..... G10H 7/00 84/723
8,816,181 B2 8/2014 Shemesh
8,940,991 B2 * 1/2015 Shemesh ..... G10H 7/00 84/615
2012/0204704 A1 8/2012 Shim et al.
2013/0152770 A1 * 6/2013 Cappello ..... G10D 13/022 84/730

* cited by examiner

*Primary Examiner* — Robert W Horn
(74) *Attorney, Agent, or Firm* — Butzel Long

(57) ABSTRACT

A percussion instrument includes a drum shell, a batter head maintained under tension by a rim secured to the top of the drum shell, a flexible member supported at the bottom end of the drum shell, a contact microphone retained on a central section of the flexible member, an acoustic transmission structure in contact with the batter head, and a drive foot coupled to a lower end of the acoustic transmission structure. The contact microphone can be coupled to the flexible support member with a first double-sided adhesive tape member. A foam cushion disposed between the drive foot and the contact microphone can be coupled to the drive foot on a top side with a second double-sided adhesive tape member and on the opposite bottom side with a third double-sided adhesive member to reduce unwanted microphonics or feedback, and allow rapid reversion of the signal from the contact microphone.

21 Claims, 2 Drawing Sheets

ELECTRONIC DRUM

CROSS-REFERENCE TO RELATED APPLICATIONS

Not applicable.

FIELD OF THE DISCLOSURE

This disclosure relates to percussion musical instruments, and in particular drum sets, that employ electroacoustic transducers to convert mechanical energy, generated when a head of the instrument is struck, into an electrical signal that can be processed to drive a loud speaker.

BACKGROUND OF THE DISCLOSURE

Audiences and musical performers generally prefer the appearance, sound, and in the case of the percussionist, the feel of an acoustic drum, as compared with electronic drums. Electronic drums that have the feel of an acoustic drum, and which produce a sound comparable to an acoustic drum are generally very expensive and generally do not have the appearance of acoustic drums.

An important advantage of electronic drums is that they eliminate the need for appropriately positioning microphones for the drums, which can be a tedious and time-consuming process. Another important advantage of electronic drums, is that it is easy to change the sound of the drum by adjusting settings on an electronic controller or computer.

Attempts have been made to provide kits for converting an acoustic drum to an electronic drum. While such modifications are relatively easy and inexpensive, there are associated disadvantages. Such conversions generally require permanent modifications to the drum shell, such as drilled mounting holes that degrade the appearance of the drum. Durability and playability is generally poor. The playability of triggers using foam dampening quickly deteriorates with use, resulting in inconsistent trigger response, which ultimately makes the converted drum unplayable. The triggers used in such conversion kits provide inferior sound quality and a very small sweet spot, such as approximately 2 inches (5 cm) in diameter, where a strike will produce an acceptable drum beat.

SUMMARY OF THE DISCLOSURE

Described is an electronic drum that can have the appearance, sound and feel of an acoustic drum. The disclosed drums can either be made as electronic drums or can be made by converting acoustic drums without requiring any permanent modifications to the drum shells or associated hardware (e.g., stands, drum head fasteners, etc.).

In certain aspects of this disclosure, a percussion instrument includes a drum shell, a flexible batter head maintained under tension by a first rim secured to a top of the drum shell, a flexible bottom head maintained under tension by a second rim secured to a bottom of the drum shell, a flexible and resiliently compressible member supported on the bottom head, and a contact microphone that is not directly supported by the drum shell and which is disposed within the drum shell between the batter head and the bottom head, with the contact microphone indirectly supported by the drum shell between the batter head and bottom head. This arrangement can allow the contact microphone to be axially displaced within the drum shell from a rest position when the batter head is struck and resiliently urged back to the rest position between strikes on the batter head.

In certain aspects of this disclosure, a percussion instrument includes a drum shell, a batter head maintained under tension by a rim secured to a top of the drum shell, a flexible member supported at a bottom end of the drum shell, a contact microphone retained on a central section of the resiliently flexible support member, an acoustic transmission structure in contact with the batter head, and a drive foot coupled to a lower end of the acoustic transmission structure. The acoustic transmission structure and the drive foot are arranged in the percussion instrument so that they are compressed between the batter head and the flexible member with the drive foot positioned over the contact microphone. Force from a strike on the batter head is transmitted from the batter head to the acoustic transmission structure, through the acoustic transmission structure and the drive foot, and from the drive foot to the contact microphone. The contact microphone converts the transmitted force or pressure into an electrical signal that can be amplified, modulated or otherwise electronically modified before driving a speaker.

In certain aspects of this disclosure, the drum shell can have a cylindrical shape or a frustoconical shape.

In certain aspects of this disclosure, the batter head is made of a mesh fabric that allows air to pass through. The mesh batter head is selected to have a rebound characteristic of a conventional acoustic batter head.

In certain aspects of this disclosure, the flexible member has a disc shape and is generally coextensive with an opening at the bottom of the drum shell.

In certain aspects of this disclosure, the contact microphone is a piezoelectric microphone.

In certain aspects of this disclosure, the acoustic transmission structure has an upper annular surface in contact with an annular surface at an underside of the batter head, and the acoustic transmission structure tapers toward a central area at the bottom of the drum shell. As an example, the acoustic transmission structure can have an inverted frustoconical shape.

In certain aspects of this disclosure, the coupling of the drive foot to the acoustic transmission structure is adjustable to vary the compression exerted on the acoustic transmission structure and drive foot by the batter head and flexible support member.

In certain aspects of this disclosure, the contact microphone is retained between a bottom surface of the drive foot and a top surface of the flexible support member, and is constrained from moving laterally across the upper surface of the flexible support member.

In certain aspects of this disclosure, the contact microphone is coupled or adhered to a section of the upper surface of the flexible support member, such as with a double-sided adhesive tape or other adhesive composition.

In certain aspects of this disclosure, a foam cushion is positioned between a bottom surface of the drive foot and a top surface of the contact microphone. The foam cushion can be coupled or adhered to the underside of the drive foot, and/or to the contact microphone, such as with a double-sided adhesive tape or other adhesive composition.

In certain aspects of this disclosure, the contact microphone is retained between the flexible support member and a foam cushion, and the drive foot is retained between the foam cushion and a compression foam member.

In certain aspects of this disclosure, the contact microphone, foam cushion, drive foot and compression foam member are retained on the flexible support member by a plurality of pins having internally threaded bores at their upper ends, a pressure plate having openings through which the upper ends of the pins extend, and a plurality of threaded screws that engage the threaded bores of the pins and compress the foam cushion and the compression foam member between the pressure plate and the flexible support member.

In certain aspects of this disclosure, the drive foot is adjustably coupled to the lower end of the acoustic transmission structure by an externally threaded shank, and the lower end of the acoustic transmission structure has an internally threaded bore for receiving and threadingly engaging the threaded shank.

In certain aspects of this disclosure, the acoustic transmission structure is a hollow, inverted frustoconically shaped component having openings in the conical walls to reduce or eliminate the effects of air pressure acting on surfaces of the acoustic transmission structure.

DETAILED DESCRIPTION

Figure 1:
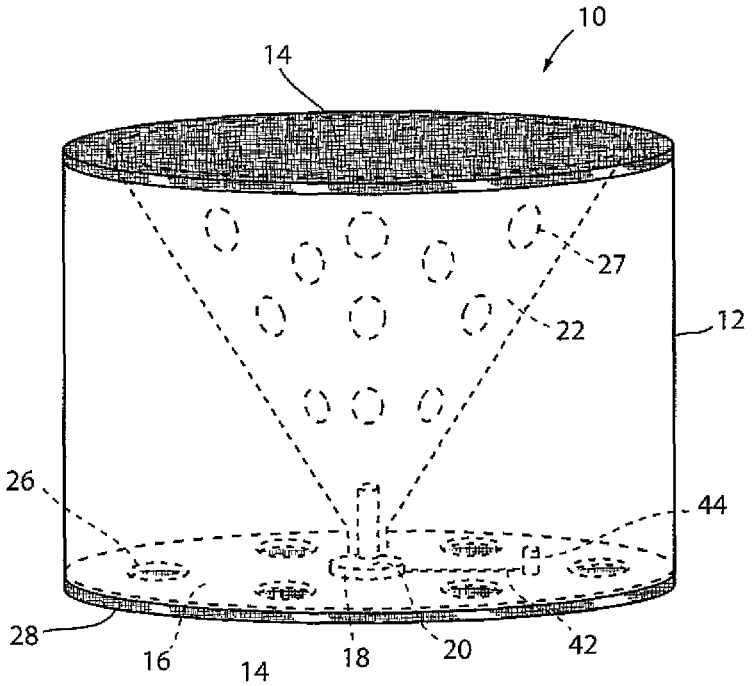
FIG. 1 is a perspective view of a drum in accordance with this disclosure.

FIG. 1 shows a percussion instrument 10 in accordance with this disclosure. The percussion instrument or drum 10 includes a drum shell 12, a batter head 14, secured to a top end of the drum shell, a flexible member 16 supported at a bottom end of the drum shell, an electronic pressure sensor or contact microphone 18, a drive foot 20, and a convergence cone or acoustic transmission structure 22.

The contact microphone 18 can be coupled to a section of the upper surface of flexible support member 16. Non-rigid coupling, such as with an adhesive tape member 23, can be used to restrict undesirable movement of the contact microphone relative to the flexible support member and prevent unwanted microphonics (rustling or thumping noises) or feedback. A suitable double-sided adhesive tape could comprise a pressure-sensitive, non-hardening adhesive applied to both sides of a fiberglass/polyester scrim. Such double-sided adhesive tape has the ability to bond dissimilar materials and to dampen vibrations.

The drum 10 is designed so that when batter head 14 is struck, forces are transmitted from batter head 14 to an upper annular surface 24 of acoustic transmission structure 22 that is in contact with a corresponding annular surface on the underside of batter head 14. The forces are transmitted downwardly through the acoustic transmission structure 22 and directed or focused toward a lower end of structure 22, and transmitted through drive foot 20 and to the sensing surface of contact microphone 18.

Figure 3:
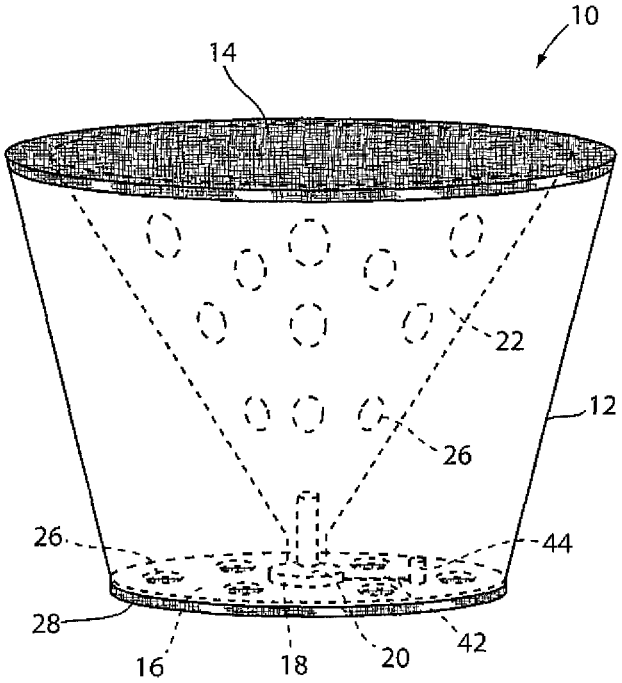
FIG. 3 is a perspective view of an alternative drum having an inverted frustoconical shape.

Drum shell 12 can take generally any form, including an open frame structure, if desired. Drum shell 12 can have a conventional cylindrical shape, an inverted frustoconical shape (i.e., the larger base of the frustoconical form at the top as shown in FIG. 3), or generally any other shape capable of supporting the elements of the disclosed drums.

The batter head 14 can be made of a mesh material to allow air to pass through when the batter head is struck and prevent the formation of pressure waves. Mesh batter heads that provide rebound and a drum feel comparable to a conventional batter head are commercially available, and are typically used during practice where standard drum acoustic volumes are an issue. The batter head 14 is maintained under tension by a rim. The batter head can either be pre-tuned, meaning that the batter head is pre-tensioned on a drum hoop securable to the drum shell, or tuned by using a drum key to adjust tension rods that secure a rim to lugs fixed on the outer surface of the drum shell.

The flexible support member 16 can be a flat disc that supports the contact microphone 18. The flexible support member 16 is generally less flexible than batter head 14, and more flexible than the acoustic transmission structure 22. The flexible support member 16 can exhibit a combination of excellent resilience, elasticity and rebound. Examples of suitable materials for the flexible support members include thermoplastic elastomers such as styrene block copolymers (e.g., Kraton Polymers), polyolefin blends (TPE-o), and thermoplastic polyurethanes (TPU). It is also possible that flexible support member 16 could be made of wood, such as a thin plywood. Flexible support member 16 can comprise other structures, such as a narrow transverse member extending across the bottom of drum shell 12. Air openings 26 can be provided in the flexible support member 16 to allow pressure waves to rapidly dissipate.

Contact microphone 18 can be generally any type of microphone designed to sense acoustic or mechanical vibrations conducted through solid objects, while being largely insensitive to vibrations propagated through air. For example, contact microphone 18 can be a piezoelectric transducer (e.g., a piezoelectric microphone).

Acoustic transmission structure 22 can be generally any solid structure capable of transmitting audio vibrations from the batter head 14 and to the drive foot 20. In order to provide consistent volume and sound quality over the entire area of the batter head 14, it is desirable that the acoustic transmission structure 22 be symmetrical along the cylindrical axis of the drum shell. It is also desirable that an upper edge of the acoustic transmission structure 22 is in contact with batter head 14 along an annular region near the edge of the batter head 14. These features help ensure that a strike on nearly any location on the batter head will produce substantially the same sound. The acoustic transmission structure 22 can have an inverted frustoconical shape (i.e., a convergence cone) that has a large drive end and a small driven end, with the small driven end at the bottom of the drum shell and the large drive end at the top of the drum shell and in contact with the batter head 14. The driven end of the convergence cone (inverted frustoconical acoustic transmission structure 22) is coupled to drive foot 20, which is positioned to transmit audio vibrations to the contact microphone 18. The inverted frustoconical shape of structure 22 causes force transmitted from the large drive end at the top of the drum to the small driven end at the bottom of the drum to intensify through converging lines of leverage (longitudinal, transverse, and vertical), so that a misdirected strike to the batter head 14 results in a near equal pressure to the contact microphone as a perfectly directed strike to the center of the batter head 14. The acoustic transmission structure 22 is provided with holes or openings 27 that allow rapid equalization of air pressure, preventing sound waves from reverberating through the air inside the drum. Structure 22 can be made of a relatively rigid plastic (less flexible than flexible member 16), such as a poly(meth) acrylate.

A mesh bottom head 28 maintained under tension by a rim can be fastened to the bottom end of drum shell 12 to support the flexible member 16. Mesh bottom head 28 can be substantially identical to mesh batter head 14.

Figure 2:
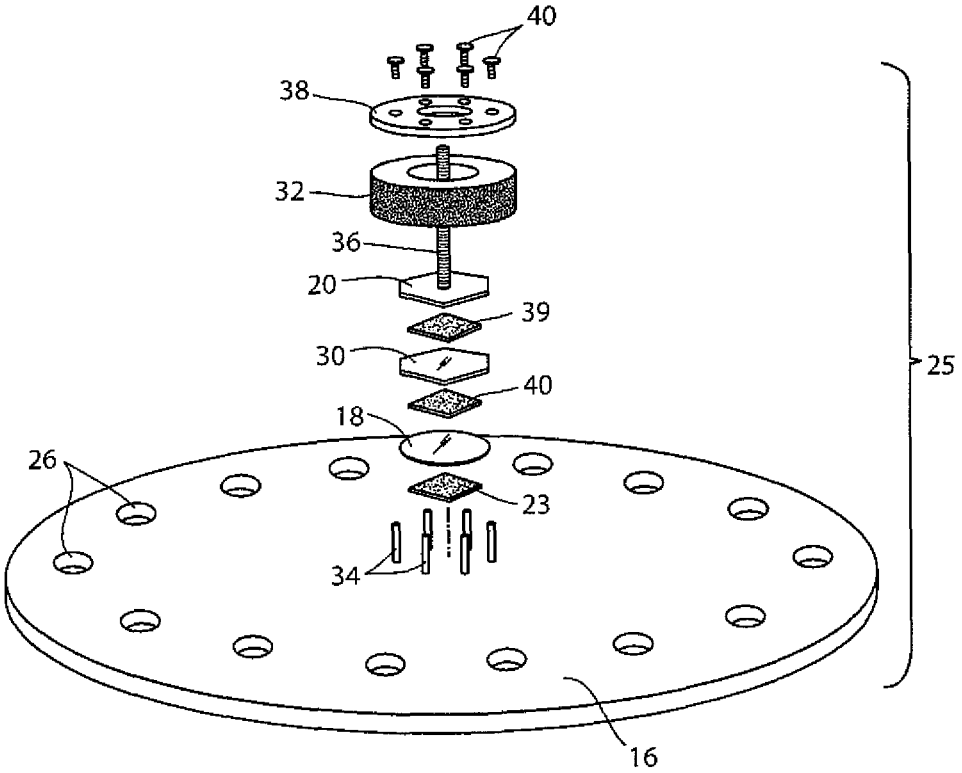
FIG. 2 is an expanded perspective view showing a subassembly of the drum shown in FIG. 1.

A subassembly 25 for retaining contact microphone 18 on flexible member 16 is shown in FIG. 2. Acoustic contact between drive foot 20 and contact microphone 18 is maintained by compressibly retaining drive foot 20 between two resiliently compressible members, foam cushion 30 and compression foam member 32. In the illustrated embodiment, six pins 34 extend upwardly through openings in flexible member 16. Contact microphone 18 is placed on flexible member 16 and is prevented from moving laterally along the upper surface of flexible member 16 by pins 34. Foam cushion 30 is positioned over contact microphone 18 and is also prevented from moving laterally by pins 34. Foam cushion 30 can be comprised of generally any resiliently deformable elastomeric foam material. Drive foot 20, which is coupled to acoustic transmission structure 22 by a threaded shank 36, is positioned between foam cushion 30 and compression foam member 32. Drive foot 20 can be comprised of a material that is less flexible than flexible member 16, foam cushion 30 and compression foam member 32. Similarly, pressure plate 38 can be comprised of a relatively rigid material. Pressure plate 38 is urged toward flexible member 16 by screws 40 received in internally threaded bores in the top ends of pins 34. As an alternative, pins 34 can have external threads and nuts can be used rather than screws to urge plate 38 toward member 16 to compress contact microphone 18, cushion 30, foot 20 and compression foam member 32 therebetween.

The compression foam 32 only surrounds the outside perimeter of the pins 34 and contacts the bottom side of pressure plate 38, but only at the edge outside of pin hole locations. Foam 32 does not rest on top of the foot 20. The pins 34 are an exact height to allow the foot 20 to have 2 millimeters of unrestricted travel upward upon completed assembly of the coupling device, i.e., the foot 20 tops out on the bottom of pressure plate 38 with no cushion device in between. The cushion 32 surrounding pins 34 reduce vibration of pins 34 and constrict the pins 34 to the foot 20. The six pins 34 coincide with the hexagon foot 20. This stops the foot 20 from rotating during play and causing the drum to detune.

Foam cushion 30 can be coupled to the underside of drive foot 20. Non-rigid coupling, such as with a double-sided adhesive tape member 39, can be used to restrict undesirable movement of foam cushion 30 relative to drive foot 20 and prevent unwanted microphonics or feedback. Also, foam cushion 30 can be coupled to the top side of contact microphone 18. Non-rigid coupling, such as with a double-sided adhesive tape member 40, can be used to restrict undesirable movement of foam cushion 30 relative to contact microphone 18 and prevent unwanted microphonics or feedback. Double-sided adhesive tape members 39, 40 can comprise a pressure-sensitive, non-hardening adhesive applied to both sides of a fiberglass/polyester scrim, which facilitates bonding and helps dampen vibrations.

The use of double-sided adhesive tape members or other non-rigid coupling member helps quench or relieve pressure applied to the contact microphone 18 and allow the batter head 14 to rebound quicker than flexible support member 16 after striking, thereby allowing the signal from the contact microphone to quickly revert.

The arrangement, shown in FIG. 2 and described above, for coupling the drive foot 20 and microphone 18 allows the contact microphone 18 to unload and return to neutral quickly. This is achieved by allowing the flexible member 16 to quickly rebound and lift the drive foot 20, allowing the contact microphone 18 to revert its signal quickly.

Flexible member 16 provides sufficient firmness while also providing a dampening effect to the microphone 18. The arrangement allows the microphone 18 to move freely or float vertically with a degree of controlled resistance, while inhibiting or preventing longitudinal or transverse movement.

An electrical lead 42 electrically connects the output signal from the microphone 18 to a stereo or monaural jack 44 for an amplifier or other equipment.

The drum described herein can have the feel, sound and appearance of an acoustic drum, while having the advantage of an electronic drum, including elimination of microphones for performances and recordings and the ability to easily adjust volume and tone.

Unlike conventional drum pick-up microphones that are rigidly affixed to the drum shell, the contact microphone 18 is not directly supported by the drum shell 12, but is instead compressed between and/or supported by the springy batter head 14 and bottom head 28. This arrangement prevents so called "stacking" problems associated with contact microphones, such as piezoelectric microphones, in which pressure from a series of strikes can cause accumulated effects that generate signals that are not representative of the actual strikes on the batter head. By compressing the contact microphone 18 between heads 14 and 18, which act as springs, the contact microphone is allowed to move in the direction of the drum axis when the batter head is struck and quickly revert to its original rest position between strikes, allowing the contact microphone to quickly revert its signal and avoid accumulated effects.

Current designs have no means to imply a reverting effect to the contact microphone. With the flexible support member 16 secured to the drum shell 12 by the bottom drum head, the flexible support member 16 becomes a spring capable of compression and rebound. The top drum head having much less mass than the assembly below it, as well as less of a resistance to pressure, has more travel, rebounds quicker after compressing, and relieves pressure from the acoustic transmission structure. This reduces the pressure applied to the contact microphone by the foot 20 allowing the contact microphone to revert its signal quickly and allowing the flexible support member 16 to begin rebounding. We are showing a degree of control before and after to quickly dampen and control unwanted movement as well as eliminate vibrations that keep the contact microphone excited and create microphonics. The key factors creating this function being the springs and mass on each side of the contact microphone.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the claims attached herein.

What is claimed is:

1. A percussion instrument comprising:

a drum shell having a top end and a bottom end;

a batter head maintained under tension by a rim secured to the top end of the drum shell;

a flexible support member secured to the bottom end of the drum shell;

a contact microphone retained on a central section of the flexible member;

an acoustic transmission structure in contact with the batter head, the acoustic transmission structure configured to transmit acoustic vibrations from the batter head toward the bottom end of the drum shell;

a drive foot coupled to a lower end of the acoustic transmission structure; and the acoustic transmission structure and the drive foot being compressed between the batter head and the flexible member with the drive foot positioned over the contact microphone such that an acoustic force generated by a strike on the batter head is transmitted through the acoustic transmission structure and through the drive foot to the contact microphone.

2. The percussion instrument of claim 1, wherein the contact microphone is coupled to the flexible support member with a double-sided adhesive tape member.

3. The percussion instrument of claim 1, wherein the drum shell has a cylindrical shape.

4. The percussion instrument of claim 1, wherein the drum shell has an inverted frustoconical shape.

5. The percussion instrument of claim 1, wherein the batter head is comprised of a mesh fabric to allow air to pass through the batter head when struck.

6. The percussion instrument of claim 1, wherein the mesh batter head has a rebound characteristic of a conventional batter head.

7. The percussion instrument of claim 1, wherein the flexible support member has a disc shape generally coextensive with a circular opening at the bottom end of the drum shell.

8. The percussion instrument of claim 1, wherein the contact microphone is a piezoelectric microphone.

9. The percussion instrument of claim 1, wherein the acoustic transmission structure has an upper portion in contact with areas of an underside of the batter head that are spaced immediately adjacent from the rim of the batter head.

10. The percussion instrument of claim 1, wherein the acoustic transmission structure has an upper annular surface in contact with an annular surface of an underside of the batter head.

11. The percussion instrument of claim 1, wherein the acoustic transmission structure has an inverted frustoconical shape and includes an upper annular surface in contact with a concentric annular surface on an underside of the batter head.

12. The percussion instrument of claim 1, wherein the coupling of the drive foot to the acoustic transmission structure is adjustable to vary the compression exerted by the batter head and the flexible support member on the drive foot and acoustic transmission structure.

13. The percussion instrument of claim 1, wherein the contact microphone is retained between a bottom surface of the drive foot and a top surface of the flexible support member, and is constrained from moving laterally, and is not affixed to the structure constraining lateral movement, the flexible support member or the drive foot.

14. The percussion instrument of claim 1, further comprising a foam cushion disposed between a bottom surface of the drive foot and a top surface of the contact microphone.

15. The percussion instrument of claim 14, wherein the foam cushion is coupled to the drive foot with a first double-sided adhesive tape member and to the contact microphone with a second double-sided adhesive tape member.

16. The percussion instrument of claim 1, in which the contact microphone is retained between the flexible support member and a foam cushion and the drive foot is retained between the foam cushion and a compression foam member.

17. The percussion instrument of claim 16, in which the contact microphone, foam cushion, drive foot, and compression foam member are retained on the flexible support member by a plurality of pins having internally threaded bores at their upper ends, the pins extending upwardly through openings in the flexible support member, a pressure plate having openings through which the upper ends of the pins extend, and a plurality of threaded screws that engage the threaded bores of the pins and compress the foam cushion and the compression foam member.

18. The percussion instrument of claim 1, in which the drive foot is adjustably coupled to the lower end of the acoustic transmission structure by an externally threaded shank, and the lower end of the acoustic transmission structure has an internally threaded bore for engaging the threaded shank.

19. The percussion instrument of claim 1, in which the acoustic transmission structure is a hollow, inverted frustoconically shaped component having openings to eliminate or reduce the effects of air pressure acting on the acoustic transmission structure.

20. A percussion instrument comprising:

a drum shell having a top end and a bottom end;

a flexible batter head maintained under tension by a first rim secured to the top end of the drum shell;

a flexible bottom head maintained under tension by a second rim secured to the bottom end of the drum shell;

a flexible and resiliently compressible member supported at a bottom end of the drum shell; and a contact microphone coupled to an upper surface of the flexible and resiliently compressible member and compressed between the batter head and the flexible member, such that the contact microphone is axially displaceable from a rest position within the drum shell when the batter head is struck and resiliently urged back to the rest position by the flexible member, bottom head and batter head between strikes on the batter head.

21. A percussion instrument comprising:

a drum shell having a top end and a bottom end;

a batter head maintained under tension by a rim secured to the top end of the drum shell;

a flexible structure secured to and extending across the bottom end of the drum shell;

a contact microphone retained on a central section of the flexible structure; and a solid structure that is less flexible than the flexible structure having an upper end in contact with the batter head and a lower end in contact with a drive foot, the solid structure compressed between the batter head and the flexible member with the drive foot positioned over the contact microphone such that an acoustic force generated by a strike on the batter head is transmitted through the acoustic transmission structure and through the drive foot to the contact microphone.

* * * * *